US011085167B2

(12) United States Patent
Walliman

(10) Patent No.: US 11,085,167 B2
(45) Date of Patent: Aug. 10, 2021

(54) BUILDING FOUNDATION REPAIR PIER AND PERMANENT SUPPORT

(71) Applicant: Greg G. Walliman, Mesa, AZ (US)

(72) Inventor: Greg G. Walliman, Mesa, AZ (US)

( * ) Notice: Subject to any disclaimer, the term of this patent is extended or adjusted under 35 U.S.C. 154(b) by 71 days.

(21) Appl. No.: 16/587,264

(22) Filed: Sep. 30, 2019

(65) Prior Publication Data

US 2020/0102715 A1 Apr. 2, 2020

Related U.S. Application Data

(60) Provisional application No. 62/740,316, filed on Oct. 2, 2018.

(51) Int. Cl.
*E02D 35/00* (2006.01)
*E02D 17/02* (2006.01)
*E02D 3/08* (2006.01)

(52) U.S. Cl.
CPC ..... *E02D 35/005* (2013.01)

(58) Field of Classification Search
CPC ..... E02D 35/00; E02D 35/005; E02D 17/02; E02D 3/08
USPC ..... 405/230, 231, 232, 256, 257
See application file for complete search history.

(56) References Cited

U.S. PATENT DOCUMENTS 3,179,374 A * 4/1965 Walli ..... E04B 1/3511 254/109
3,789,559 A * 2/1974 Kirkes ..... E04B 1/0007 52/169.9
3,796,055 A * 3/1974 Mahony ..... E02D 27/48 405/230
3,902,326 A * 9/1975 Langenbach, Jr. ..... E02D 27/48 405/230
4,563,110 A 1/1986 Langenbach, Jr. et al.
4,711,603 A 12/1987 Rippe, Jr. et al.
4,832,535 A * 5/1989 Crambes ..... E02D 3/12 405/266
5,205,673 A 4/1993 Bolin et al.
5,213,448 A 5/1993 Seider et al.
5,217,325 A 6/1993 Freeman, III
5,234,287 A * 8/1993 Rippe, Jr. ..... E02D 27/48 405/230
5,724,781 A 3/1998 Matthias et al.
6,058,663 A * 5/2000 MacKarvich ..... E02D 27/02 52/167.3
6,503,024 B2 1/2003 Rupiper
6,814,524 B1 11/2004 Peterson
6,840,714 B1 1/2005 Vache
7,470,090 B2 * 12/2008 Heppner ..... E02D 5/56 248/219.3

(Continued)

*Primary Examiner* — Edwin J Toledo-Duran
(74) *Attorney, Agent, or Firm* — James L Farmer

(57) ABSTRACT

Methods and apparatus are provided for a system for raising and permanently supporting a sunken building foundation footing. The system includes a cylindrical sleeve disposed inside a hole cored through the footing from a top surface of the footing adjacent a stem wall to a bottom surface of the footing, wherein the sleeve has an inner diameter large enough for pier extensions to pass through. A bracket positioned on the top surface of the footing over the sleeve has a center hole with a diameter equal to or greater than the inner diameter of the sleeve. The system may further include a mechanical connection from the bracket to the footing configured to carry a foundation lifting force from a hydraulic ram.

6 Claims, 10 Drawing Sheets

(56) References Cited

U.S. PATENT DOCUMENTS

| | | | | |
|---|---|---|---|---|
| 7,744,316 | B2 | 6/2010 | Kaufman | |
| 7,780,376 | B2 | 8/2010 | Bracken et al. | |
| 8,540,461 | B2 | 9/2013 | Ong | |
| 9,279,227 | B2 | 3/2016 | West | |
| 2002/0062622 | A1* | 5/2002 | Bell | E02D 35/00 52/741.15 |
| 2005/0220544 | A1* | 10/2005 | Bisson | E02D 35/00 405/230 |
| 2006/0216117 | A1* | 9/2006 | Peterson | E02D 35/00 405/230 |
| 2007/0092340 | A1* | 4/2007 | Zidar | E02D 35/00 405/230 |
| 2009/0003938 | A1* | 1/2009 | Nishimori | E02D 5/80 405/232 |

* cited by examiner

A-A

B-B

BUILDING FOUNDATION REPAIR PIER AND PERMANENT SUPPORT

TECHNICAL FIELD AND BACKGROUND

Provisional Patent Application Ser. No. 62/740,316, to which the present application claims priority, is hereby incorporated by reference. The technical field of the present invention relates to methods and apparatus for raising and leveling sunken building foundation stem walls and footings.

DESCRIPTION OF THE EMBODIMENTS

The instant invention is described more fully hereinafter with reference to the accompanying drawings and/or photographs, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
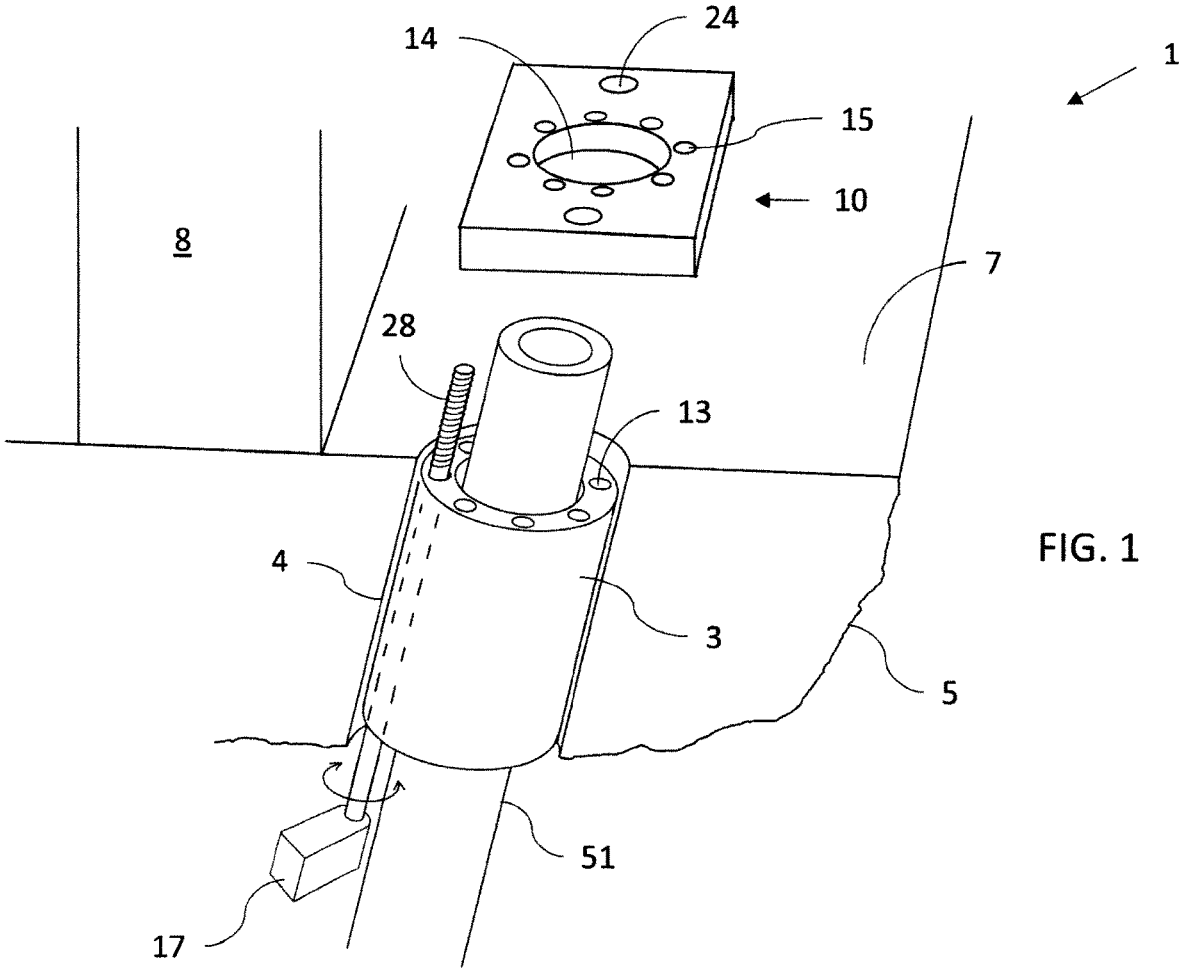
FIG. 1 is a perspective, partially cut-away and exploded view of one exemplary embodiment of a building foundation repair pier and permanent support system in accordance with the present disclosure shown with a foundation footing and stem wall but without a pile cap.
Figure 2:
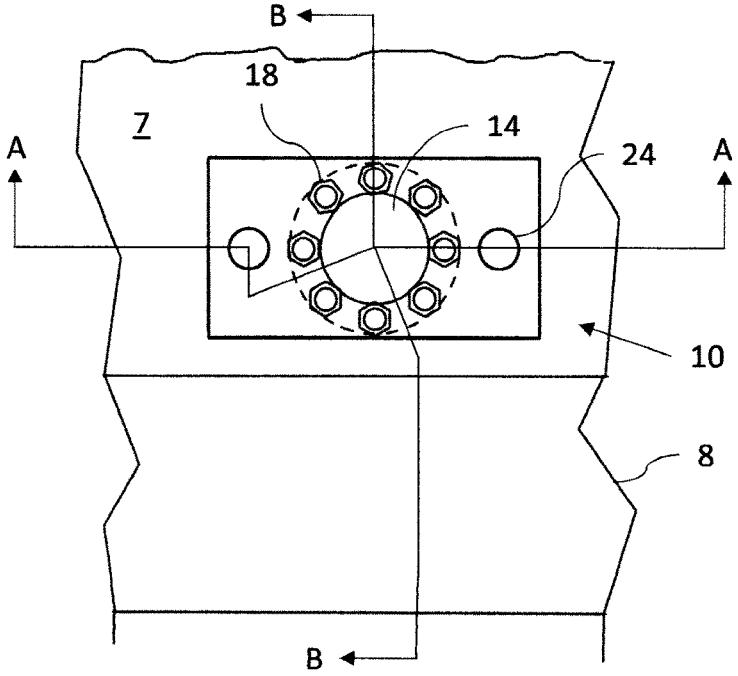
FIG. 2 is a top view of the foundation repair and support system of FIG. 1 installed in a building foundation footing without the pier and pile cap.
Figure 3:
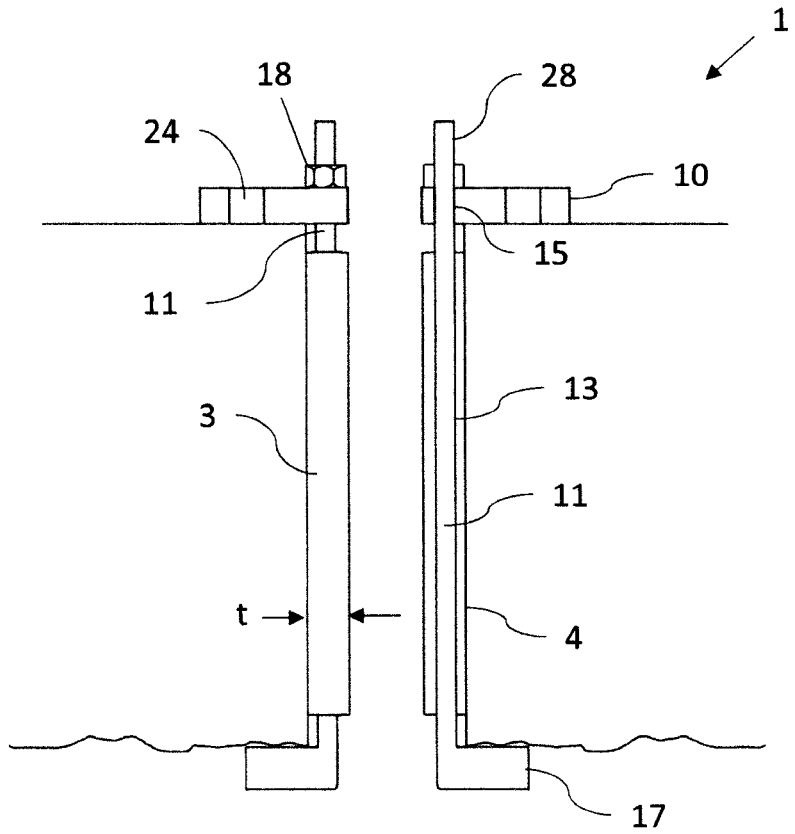
FIGS. 3 and 4 are cross-section views of the installed foundation repair and support system of FIG. 2.
Figure 4:
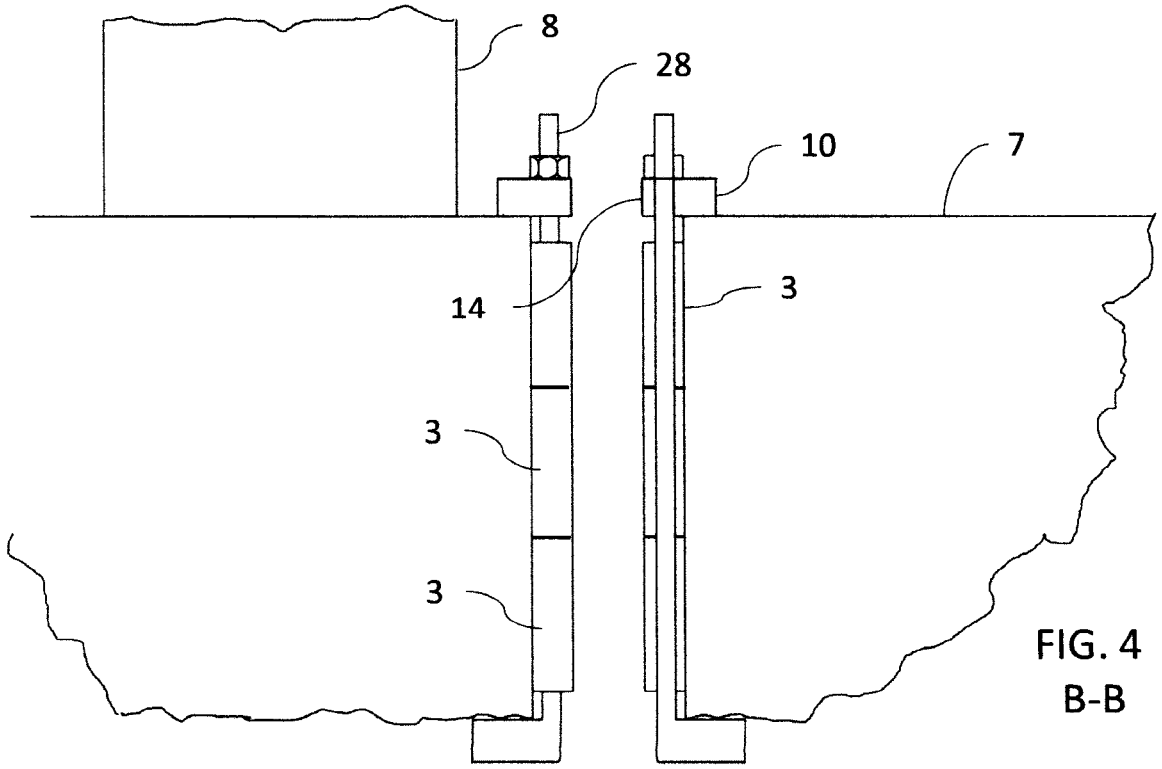

Referring now to the drawing Figures, and initially to FIGS. 1 through 4, an exemplary foundation repair and support system is indicated generally at reference numeral 1. The system utilizes a liner, or sleeve 3 disposed in a hole 4 cored through a concrete footing 5 of a building to impart a lifting force to the footing. The sleeve may be a one-piece cylinder as shown in FIGS. 1 and 3, or multiple stacked cylindrical segments as shown in FIG. 4. The hole 4 is cored preferably from the top down in a vertical/plumb path (or slightly angled as suggested by FIG. 1), through a toe portion 7 of the footing adjacent the stem wall 8. The sleeve 3 provides a guide for insertion of pier extensions 51 and facilitates anchoring of a bracket 10 to the footing. Note that the pier extensions 51 and pile cap 50, which are part of the final assembly once the foundation has been lifted, are not included in FIGS. 1 through 4, and several other Figures, mainly for clarity, and also to show sleeve installation prior to the foundation lifting process. As described in greater detail below, the anchoring can occur either at the interface of the sleeve and hole, in which case the sleeve itself is the anchor, or around the hole on the underside of the footing using special anchor bolts, with the sleeve functioning primarily as a guide.

The embodiment of FIGS. 1-4 is an example of the latter version. A series of anchor bolts 11 extend from a lower end below the sleeve 3 and footing 5, up through the sleeve wall to the bracket 10 on top of the footing. The anchor bolts pass through a series of evenly spaced, longitudinally extending guide holes 13 in the wall of the sleeve, and a mirrored series of mounting holes 15 in the bracket 10. The sleeve 3 may be a cylinder as shown, with an outer diameter slightly smaller than the diameter of hole 4 in the footing, and an inner diameter large enough to allow for the piling/pier segments to pass through. For example, in one embodiment the diameter of the footing hole 4 is 5 inches, the outer diameter of the sleeve is 4¾ inches, and the inner diameter of the sleeve is 3 inches. The sleeve in that case has a wall thickness 't' (see FIG. 3) of ⅞ inches.

The sleeve dimensions may also be selected to ensure that the wall thickness is large enough so that a guide hole diameter needed for a desired anchor bolt size does not produce a thin wall condition that compromises the structural integrity of the sleeve. To avoid that, the sleeve dimensions may be selected to ensure that the minimum wall thickness at the guide holes is at least some pre-defined minimum value. For example, assuming a minimum allowable wall thickness of 3/32 inches at the guide holes, the maximum guide hole diameter possible with the ⅞-inch-thick sleeve described above is 11/16 inches. A guide hole this size would thus allow for the use of a ⅝ inch diameter anchor bolt with 1/16 inch diametral clearance in the guide hole.

The sleeve dimensions and allowable thickness values will naturally vary with choice of material and fabrication method used for the sleeve. In one embodiment the sleeve is a made of a high strength material such as steel, or any other high strength metal alloy, or non-metal composite. The sleeve may be a unitary homogenous structure created by processes such as forging, extruding, casting, and other known manufacturing techniques. In one embodiment the sleeve is a forged steel cylinder, and the guide holes are machined. Alternatively, the sleeve may be a fabrication of two or more parts that are assembled and consolidated into a unitary structure by known processes such as welding, brazing, or autoclave bonding.

Figure 5:
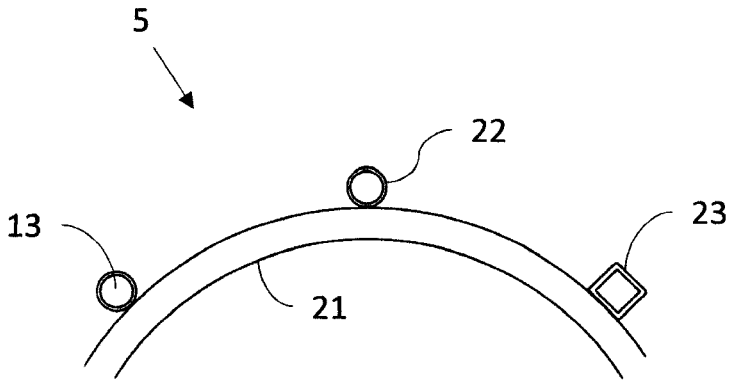
FIG. 5 is a partial cross section of a sleeve portion of the foundation repair and support system fabricated from common metal products.

FIG. 5 depicts one such example in which the sleeve is an assembly made of preferably commonly available steel products. A series of round tubes 22 are attached around the perimeter of a pipe 21. The pipe 21 defines the inner diameter of the sleeve, and the tubes 22, or alternative square tubing 23, define the guide holes 13 for anchor bolts 11. The parts may be welded or brazed using known fabrication techniques to form a single consolidated structure.

Referring now again to FIGS. 1 through 4, the bracket 10 is positioned atop the footing and secured by the upper ends of the anchor bolts 11, directly over the hole 4 and sleeve 3. A center hole 14 in the bracket aligns with the cored footing hole 4 when the bracket is in place on the footing. The diameter of hole 14 may be the same or larger than the inside diameter of sleeve 3, and at any rate is large enough to allow pier segments to pass through both the bracket and the sleeve without interference or binding. The bracket 10 may be a simple, thick rectangular plate as shown, with a pair of threaded holes 24 for attachment of hydraulic equipment used for driving the pier extensions and lifting the foundation, and ultimately for attaching the pile cap. In one embodiment the bracket is at least 1 inch in thickness. Alternatively, the features for attaching to bracket 10 may take other forms depending upon the method used for anchoring to the footing, and the particular design of the hydraulic components or pile cap being attached.

The anchor bolts 11 (aka L-clips) are essentially L-shaped, each having a right-angle flange 17 at the lower end. The flange may be simply the end of the anchor bolt bent at a right angle, much like a standard L-bolt, or a separate threaded or welded on plate or block as suggested in the Figures. As can be seen in FIGS. 3 and 4, the flange 17 is long enough in a direction perpendicular to the anchor bolt to extend past the edge of the hole 4, while also short enough to clear an adjacent anchor bolt when the anchor bolts and flanges 17 are being rotated into position, as will be described in greater detail below. Threaded upper ends 28 of the guide bolts receive nuts 18 for securing the bracket 10 to the footing.

The sleeve 3 is installed in the footing hole 4 with the anchor bolts 11 already installed in the guide holes 13. To allow for this, the flanges 17 are configured to be movable, or rotatable, from a stowed position for inserting the sleeve, to a deployed position for anchoring the flanges to the footing. As mentioned previously, the flanges 17 must be able to rotate past the adjacent flanges and anchor bolts in order to move into the stowed position.

Figure 6:
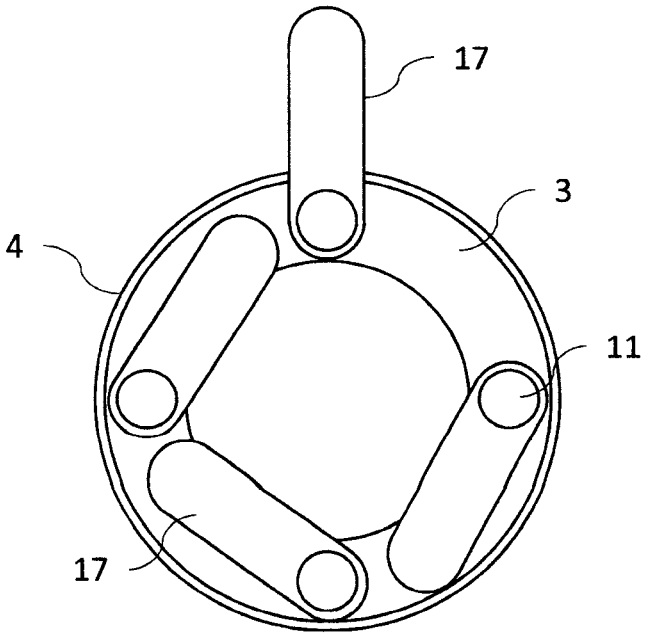
FIGS. 6-8 are bottom views of the foundation repair and support system showing different arrangements of anchor bolts and their respective right-angle flange portions.
Figure 7:
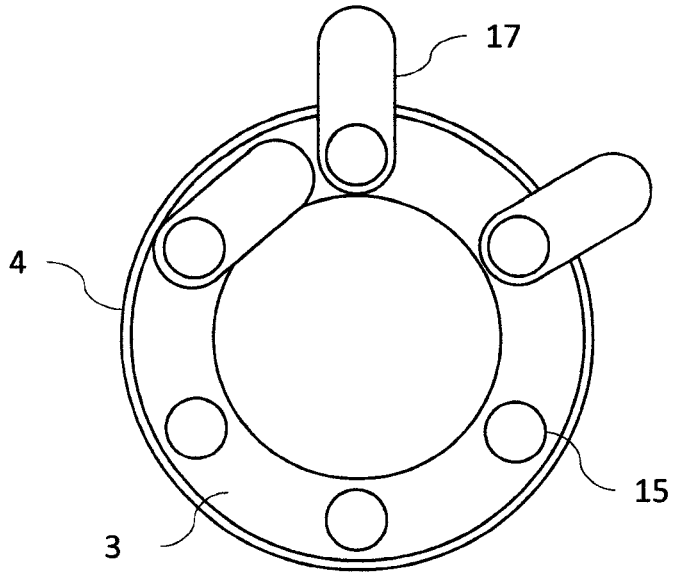
Figure 8:
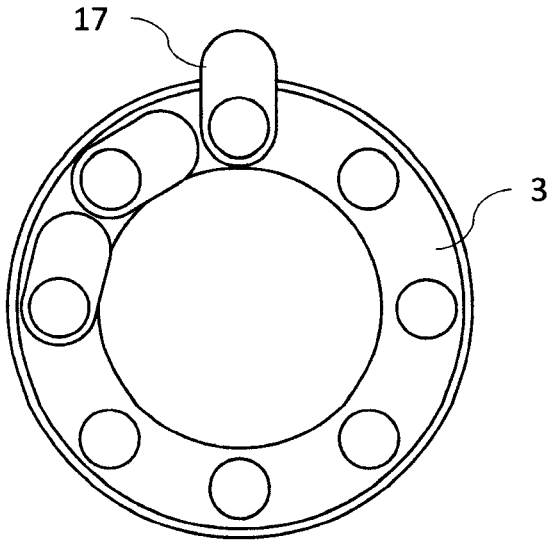
Figure 9:
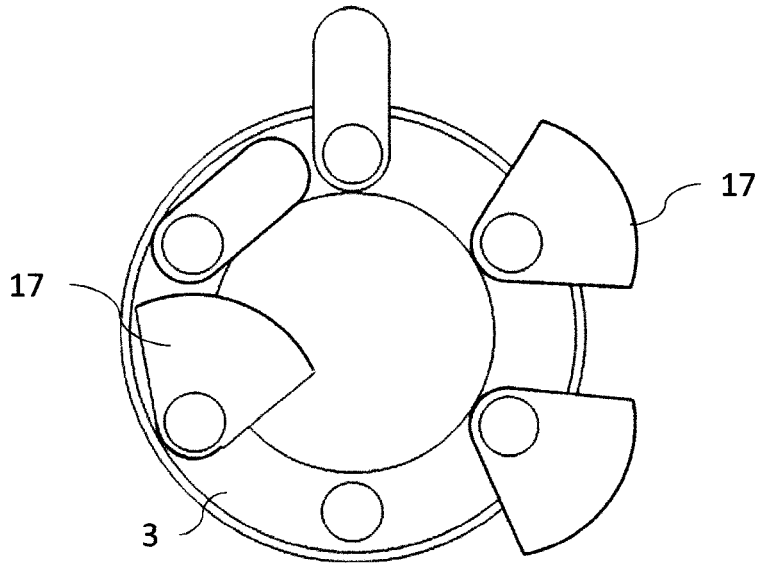
FIG. 9 is another bottom view of the foundation repair and support system with examples of trapezoidal shaped right-angle flanges.

FIGS. 6 through 8 show sleeves with three different guide bolt and flange arrangements, specifically with 4, 6, and 8 guide bolts respectively. The flanges 17 shown are intended to depict separate components, or blocks, installed on the lower ends of the guide bolts, such as with threads or welds. As can be seen from the Figures, the distal end of one flange 17 must have enough clearance from the proximal end of the adjacent flange 17 for the flange to be moved into a stowed position where it does not protrude beyond the outer edge of the sleeve. The maximum length of the flanges is therefore determined by the distance between guide bolts, which of course varies with the number of bolts used for a given sleeve size. In general, increasing the number of bolts increases the number of flanges 17 available for anchoring, while decreasing the length of each flange and amount of purchase area under the footing. FIG. 9 shows a generally trapezoidal shaped flange 17 that increases the amount of purchase area with the footing compared to the straight sided embodiment without increasing the length of the flange.

With a hole 4 cored through the footing, installation of the foundation repair and support system involves first inserting the anchor bolts 11 into the guide holes of sleeve 3 from the bottom up. The bracket 10 may then be fitted down onto the upper threaded ends 28 of the bolts protruding from the upper end of the sleeve, followed by threading the nuts 18 on the bolts at least far enough to retain the bracket. Then after rotating the anchor bolts as needed to place them all in the stowed position, the sleeve may be lowered down into hole 4.

With the sleeve properly down in the hole 4, the bolts may be rotated to the deployed positions to place the flanges 17 under the footing. However, the flanges are not visible through the middle of the sleeve once they are rotated out of the stowed position, making visual confirmation of the deployed position difficult. To account for that, the upper ends of the bolts and/or sleeve may include position indicator markings, or an indexing feature to allow for blind positioning.

Figure 10:
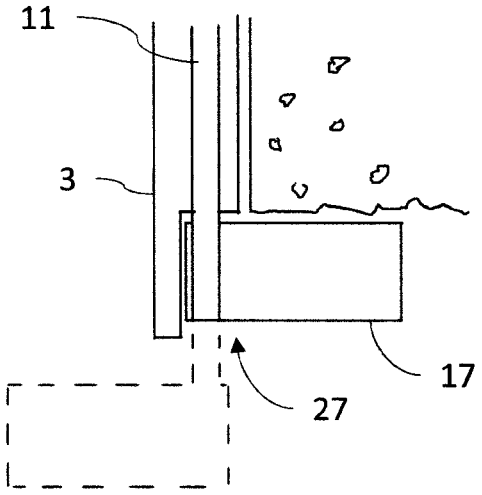
FIGS. 10 and 11 depict a slot at the lower end of the sleeve for blind positioning anchor bolts in the deployed position.
Figure 11:
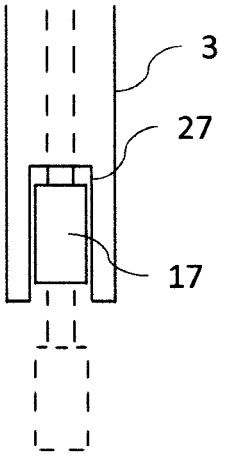

One example of an indexing feature shown in FIGS. 10 and 11 comprises a simple longitudinal slot 27 in the sleeve at the lower end. The slot 27 allows the flange 17 to move upward from the stowed position shown by dotted lines, to a raised deployed position shown in solid lines, but only when the flange is rotated into alignment with the slot. With all the flanges in the deployed position, the nuts 18 may be tightened until each one of the flanges 17 is bearing against the underside of the footing, and the bracket 10 is clamped securely down onto the top surface of the footing. An upward lifting load applied to the bracket 10 will then be carried by the anchor bolts down through the sleeve and directly to the underside of the footing by the flanges 17.

Figure 12:
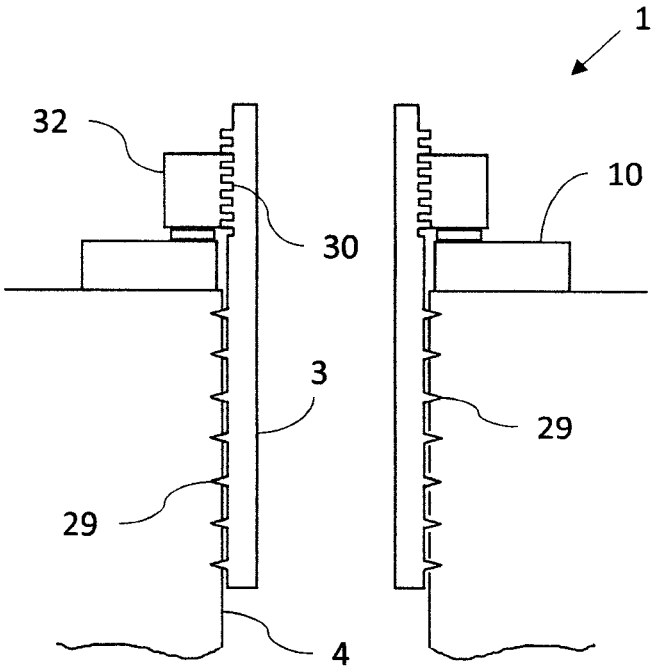
FIG. 12 is a cross section of an exemplary foundation repair and support system using a sleeve configured with concrete threads for anchoring the sleeve inside the footing, and a threaded upper end for securing the bracket.

FIG. 12 depicts another embodiment of the foundation repair system that instead of using anchor bolts for transferring load to the footing, the sleeve 3 itself functions as the anchoring device. In this embodiment the sleeve is essentially a large hollow concrete screw, with masonry threads 29 formed on the outside surface. The diameter of the hole 4 in the footing is selected to force the threads 29 to cut into the concrete for the sleeve to be screwed down into the hole. The sleeve may be long enough to protrude up above the footing and bracket 10 when the sleeve is fully screwed into the footing as shown. A machine, or acme thread 30 is provided on the proud upper portion of the sleeve, and a single large threaded ring or nut 32 is threaded onto the sleeve for clamping the bracket 10 down to the footing.

Figure 13:
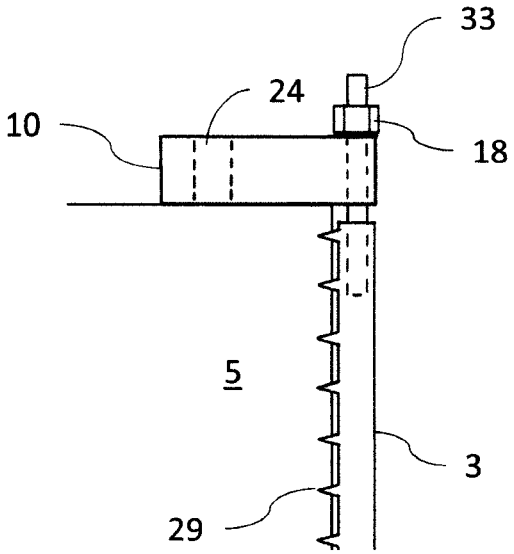
FIG. 13 is a cross section of a portion of an alternative version of the FIG. 12 sleeve using threaded studs mounted in the sleeve for securing the bracket.

Alternatively, the bracket 10 can be simply bolted to the sleeve with threaded studs 33 mounted in the sleeve extending up through holes in the bracket as shown in FIG. 13. Nuts 18 on the bolts pull the bracket down to the footing, similar in that respect to the anchor bolt embodiment of FIGS. 1 through 4. Regardless how the bracket 10 is secured, a lifting force applied to the bracket in this embodiment is transferred to the sleeve, and then directly into the footing along the inside of the hole 4 via the concrete threads 29.

Figure 14:
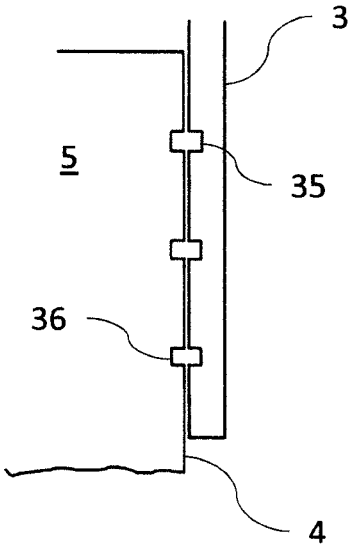
FIG. 14 is a partial cross section of another sleeve embodiment with matching grooves in the sleeve and footing hole used with an epoxy adhesive/filler for anchoring the sleeve.

In the embodiment shown in FIG. 14, the sleeve 3 is again anchored to the footing along the inside of the cored hole 4. Instead of screw threads however, the sleeve is bonded to the footing with a gap filling adhesive, such as construction epoxy, at the interface of the sleeve and hole. A series of evenly spaced circumferential grooves 35 are formed in the outer surface of the sleeve, and a matching series of grooves 36 in the wall of hole 4. The sleeve is positioned in the hole so that the grooves 35 and 36 are aligned, creating in effect multiple circular channels spaced along the length of the sleeve-hole interface as shown. Solidified adhesive filling the channels acts like multiple lock rings, enhancing the bond strength of the sleeve in the footing.

Figure 15:
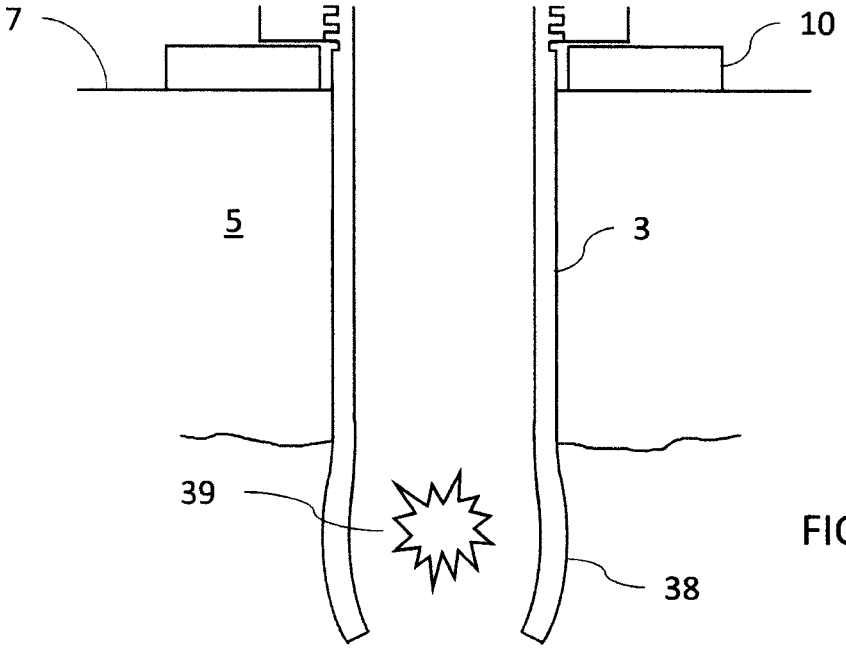
FIG. 15 is a cross section of another sleeve embodiment with an expanding anchoring portion that extends below the building footing.

Another embodiment with the sleeve serving as the footing anchor is shown in FIG. 15. The sleeve in this case is long enough to extend down below the bottom of the footing and protrude preferably by several inches, defining an anchor portion 38. The sleeve is anchored by applying a large outward pressure on the anchor portion 38 from inside the sleeve, sufficient to cause it to deform and expand outward. In one embodiment the outward pressure is the result of an explosion 39 applied by a pyrotechnic device positioned inside the anchor portion. The bracket may then be secured down to the footing using any of the configurations for the upper end of the sleeve discussed above.

Figure 16:
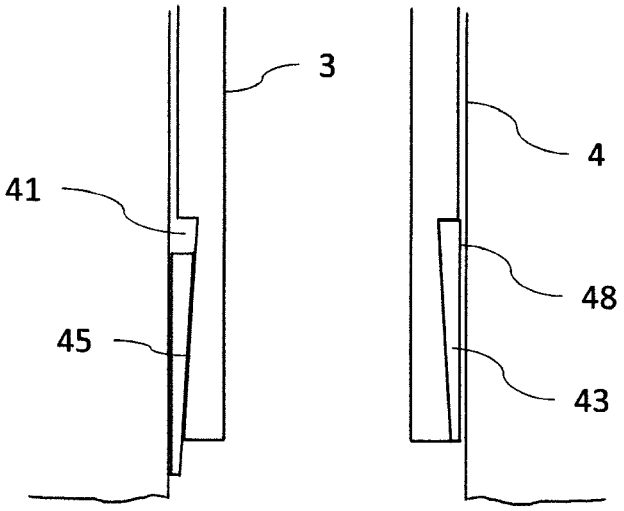
FIG. 16 is a cross section depicting another sleeve embodiment that uses a tapered wedge method to anchor the sleeve inside the footing hole.
Figure 17:
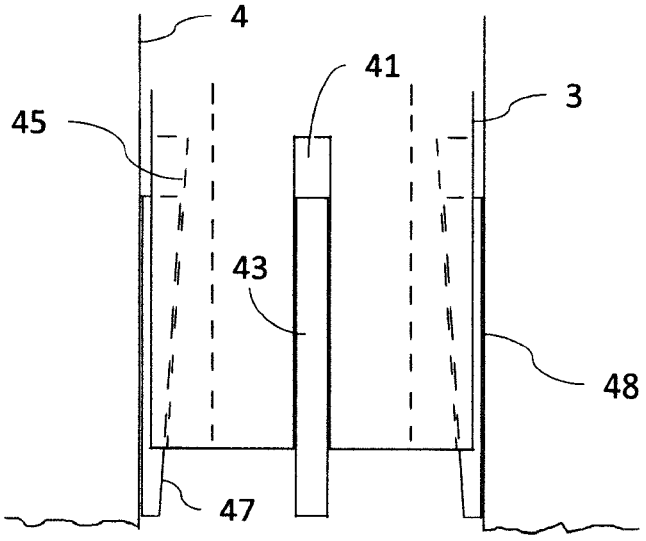
FIG. 17 is a cut-away side view of the sleeve embodiment shown in FIG. 16 that uses four wedges.

Referring now to FIGS. 16 and 17, another embodiment of sleeve 3 is configured to anchor to the inside of hole 4 through a wedging effect. A series of longitudinal grooves 41 in the outside of the lower end of the sleeve each receive an elongated wedge 43. The grooves have a bottom surface 45 that angles inward, such that the grooves increase in depth with distance from the bottom of the sleeve. The wedges have a corresponding angled inner surface 47, and an opposite facing outer surface 48 that is parallel to the outside of the sleeve.

The sleeve is installed in hole 4 with the wedges 43 slid upward to the tops of grooves 41 as shown on the right side of FIG. 16, where the wedges are flush or below flush with the outside of the sleeve. The grooves may be equipped with a releasable clip or bolt configured to temporarily hold the wedges in this position until the sleeve is lowered into the hole. When the sleeve is at the desired depth, the wedges naturally slide down and outward until contacting the wall of hole 4. If the sleeve is then lifted upward, such as by tightening one or more nuts 18 down against bracket 10, the wedges will tend to stay in place due to friction with the inside of the hole. The friction can be enhanced with grooves or teeth in the outer surfaces 48 of wedges 43. Lifting the sleeve thus causes the grooves 41 to slide upward and become progressively shallower adjacent the wedges. The wedges are driven outward against the inside of the hole 4, creating a wedging effect that eventually anchors the sleeve inside the hole, and secures the bracket 10 down to the footing.

Once the lifting system is installed with the bracket anchored, the building footing may be raised using essentially conventional foundation jacking equipment. A drive stand is initially installed next to the stem wall and attached to the bracket 10. A hydraulic drive ram is then used to drive extensions down through the sleeve and into the ground in the usual resistance pier manner to create a stable load-bearing piling. The hydraulic system is then replaced with a hydraulic lift ram attached to the bracket 10 and configured to bear against a pile cap atop the piling. The lift ram is activated, typically in series with neighboring rams and repair piers along the footing, thereby exerting a joint upward force along the footing and raising the foundation.

Figure 18:
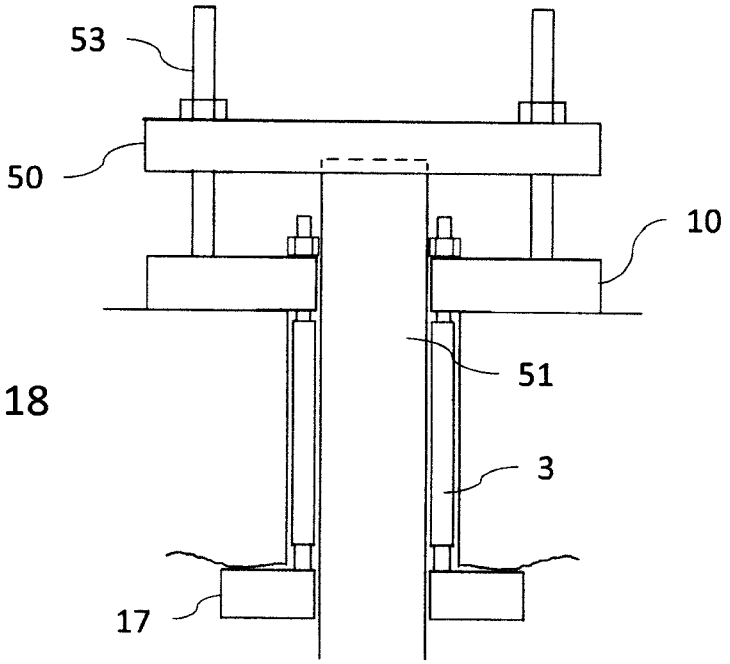
FIG. 18 depicts the final configuration of the pier repair and permanent foundation support of the present disclosure supporting a lifted building foundation on a pier.

FIG. 18 illustrates an example of the completed permanent support. The hydraulic lift components have been removed, leaving a pile cap 50 atop pier extension 51, and attached to the bracket 10, such as with threaded bolts/rods/studs 53. In this embodiment the rods 53 are simply threaded into holes 24 in bracket 10. The weight of the foundation footing is thus transferred to the pier extension 51 via pile cap 50 which is attached to the footing via rods 53, bracket 10, sleeve 3, and flanges 17.

Figure 19:
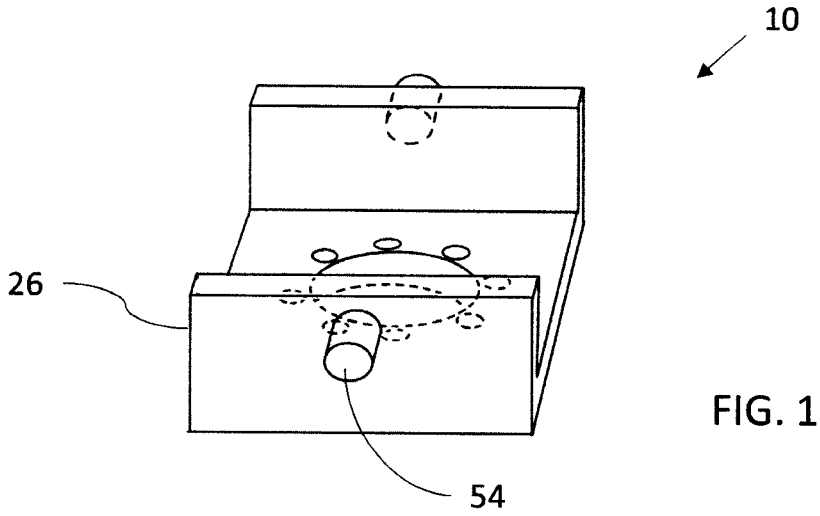
FIG. 19 is a perspective view of an alternative dog-ear embodiment of the bracket.

FIG. 19 illustrates an alternative embodiment of bracket 10 that uses cylindrical pins 54 projecting horizontally from upturned ends 26 of the bracket in a dog-ear configuration. Instead of threading bolts or studs into holes as in the previous embodiment, attachments to the bracket are made using eyebolts (not shown) that are simply slipped over the pins 54, and then attached to hydraulic equipment or the pile cap using a nut on the threaded bolt portion.

Figure 20:
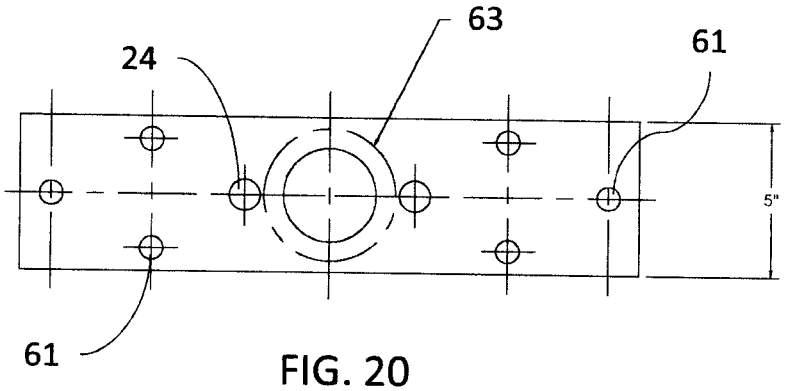
FIGS. 20 and 21 are top and section views of another alternative embodiment of the bracket configured for anchoring directly to the footing.
Figure 21:
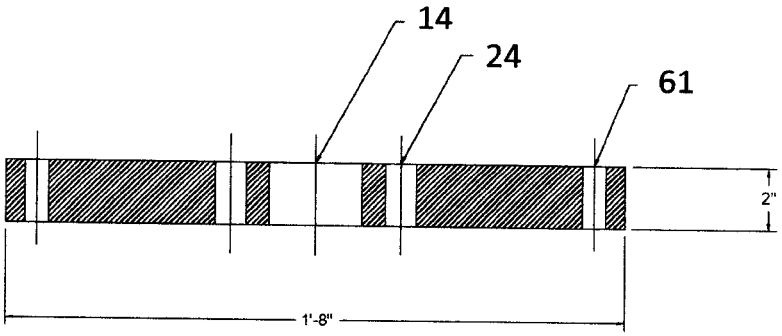

Another alternative embodiment of bracket 10 is shown in FIGS. 20 and 21. The bracket in this version is again a thick plate with a center hole 14 for the pier extensions, and a pair of threaded holes 24 for receiving the threaded rods 53. Compared to the previous embodiments, however, this version may be relatively thick, and somewhat elongated to provide room for spaced array of holes 61 at each end of the bracket. For example, in one particular embodiment the bracket is about 5 inches wide, by 20 inches long, by 2 inches thick; and has a 3-inch diameter center hole 14, holes 24 sized for a 1-inch thread, and holes 61 at least ¾ inches diameter.

The bracket is anchored to the footing by inserting concrete wedge anchors through holes 61 into holes bored in the footing, and tightening the anchors down, effectively bolting the bracket to the footing. Suitable anchors are well known and commercially available under trade names such as Simpson, Titen, ITW, and others. The anchors may be selected to be long enough to extend between half way and all the way through the thickness of the footing where the holes are bored.

The bracket of FIGS. 20 and 21 may be used with or without a sleeve 3. If a sleeve 3 is used, it may serve as a guide for insertion of pier extensions 51, whether the sleeve is participating in the anchoring of system 1 to the footing, or not. The bracket may include a ring of holes 15 (see FIG. 1) along dashed line 63 for securing a sleeve to the bracket, for example using threaded studs as shown in FIG. 13, or the upper ends of anchor bolts 11 as in FIGS. 1 through 4. In any case, the anchoring provided by the wedge anchors at holes 61 is more than adequate to carry the loads generated by the foundation lifting process without any additional anchoring through a sleeve 3.

There has been described a novel building foundation repair pier and permanent support for applying and maintaining a lifting force without compromising the structural integrity of the foundation. For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under § 112, 6th paragraph is not intended. Additionally, it is not intended that the scope of patent protection afforded the present invention be defined by reading into any claim a limitation found herein that does not explicitly appear in the claim itself.

What is claimed is:

1. A system for raising and permanently supporting a sunken building foundation footing, comprising:

a cylindrical sleeve disposed inside a hole cored through the footing from a top surface of a toe portion of the footing adjacent a stem wall to a bottom surface of the footing, wherein the sleeve has an inner diameter large enough for pier extensions to pass through;

a bracket positioned on the top surface of the footing over the sleeve, the bracket having a center hole with a diameter equal to or greater than the inner diameter of the sleeve; and a mechanical connection from the bracket through the sleeve to the footing for transmitting a lifting force from the bracket to the footing, the mechanical connection comprising a series of anchor bolts extending from a threaded upper end down through the bracket and sleeve to an L-shaped lower end configured to bear against the bottom surface of the footing when nuts on the upper ends of the anchor bolts are tightened against the bracket.

2. The system of claim 1, wherein the anchor bolts pass through a series of guide holes extending longitudinally through the sleeve between inner and outer cylindrical surfaces of the sleeve.

3. A method for lifting and supporting a sunken building foundation footing, comprising the steps of:

coring a hole from a top surface of the footing to a bottom surface through a toe portion of the footing adjacent a stem wall;

inserting a cylindrical sleeve into the hole with an inner diameter large enough for pier extensions to pass through without interference;

positioning a bracket atop the footing over the hole and sleeve;

installing a series anchor bolts in a series of guide holes extending longitudinally through the sleeve between inner and outer cylindrical surfaces of the sleeve, wherein a threaded upper end of each anchor bolt extends up through the bracket, and an L-shaped lower end is below the bottom surface of the footing;

rotating the anchor bolts until the L-shaped lower ends are extending away from the sleeve and overlapping a portion of the bottom surface of the footing around the hole; and tightening nuts on the upper ends of the bolts against the bracket; and applying a lifting force to the bracket.

4. The method of claim 3, wherein applying a lifting force to the bracket comprises the steps of:

attaching a drive stand to the bracket;

driving pier extensions through the sleeve and into the ground with a hydraulic drive ram;

replacing the drive ram with a hydraulic lift ram positioned to bear on a pile cap atop the pier extensions; and activating the hydraulic lift ram.

5. A system for raising and permanently supporting a sunken building foundation footing, comprising:

a cylindrical sleeve disposed inside a hole cored through the footing from a top surface of the footing adjacent a stem wall to a bottom surface of the footing, wherein the sleeve has an inner diameter large enough for pier extensions to pass through;

a bracket positioned on the top surface of the footing over the sleeve, the bracket having a center hole with a diameter equal to or greater than the inner diameter of the sleeve; and a mechanical connection from the bracket to the footing configured to carry a foundation lifting force from a hydraulic ram, the mechanical connection comprising a series of anchor bolts extending from a threaded upper end down through the bracket and sleeve to an L-shaped lower end below the sleeve, wherein the anchor bolts are rotatable from a stowed position in which the L-shaped lower ends are entirely under the cylinder to a deployed position in which the L-shaped lower ends extend away from the sleeve, overlapping a portion of the bottom surface of the footing around the hole.

6. The system of claim 5, wherein the anchor bolts are configured to bear against the bottom surface of the footing in the deployed position when nuts on the upper ends of the anchor bolts are tightened against the bracket.

* * * * *